US005343656A

United States Patent [19]

Loos et al.

[11] Patent Number: 5,343,656

[45] Date of Patent: Sep. 6, 1994

[54] GRINDING TOOL AND THE LIKE MADE OF A CERAMIC MATERIAL COATED WITH EXTREMELY HARD ABRASIVE GRANULES

[75] Inventors: Herbert Loos, Dorfen-Stadt; Manfred Erhardt, Puchheim; Gerhard Reichert, Esting, all of Fed. Rep. of Germany

[73] Assignee: Hurth Maschinen und Werkzeuge G.m.b.H., Munich, Fed. Rep. of Germany

[21] Appl. No.: 25,358

[22] Filed: Mar. 1, 1993

Related U.S. Application Data

[63] Continuation-in-part of Ser. No. 559,638, Jul. 30, 1990, abandoned.

[30] Foreign Application Priority Data

Aug. 1, 1989 [DE] Fed. Rep. of Germany ..... 3925364

[51] Int. Cl.[5] ..... B24D 3/14; B24D 3/18

[52] U.S. Cl. ..... 451/540; 51/295; 451/541

[58] Field of Search ..... 51/204, 209 R, 287, 51/293, 295, 296, DIG. 1

[56] References Cited

U.S. PATENT DOCUMENTS

| | | | |
|---|---|---|---|
| 2,377,995 | 6/1945 | Coes, Jr. | 51/295 |
| 3,850,590 | 11/1974 | Chalkley | 51/206 N FX |
| 3,909,990 | 10/1975 | Tersch | 51/204 |
| 4,077,808 | 3/1978 | Church | 51/295 X |
| 4,677,962 | 7/1987 | Loos | 51/287 X |
| 4,949,513 | 8/1990 | Schapp | 51/DIG. 1 |

*Primary Examiner*—Jack W. Lavinder

*Attorney, Agent, or Firm*—Flynn, Thiel, Boutell & Tanis

[57] ABSTRACT

To manufacture grinding members covered with extremely hard abrasive granules, instead of a base member of steel, a commercially available grinding tool of a corresponding shape and size made of a porous ceramic material is used as the base member. The base member is coated with an adhesive at the areas to be covered, the abrasive granules are applied and are pressed into the pores of the ceramic material; finally the adhesive is allowed to harden.

2 Claims, 1 Drawing Sheet

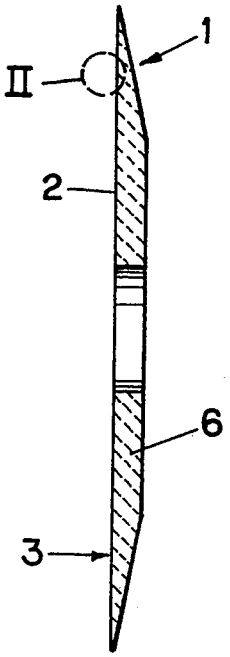
FIG. 1
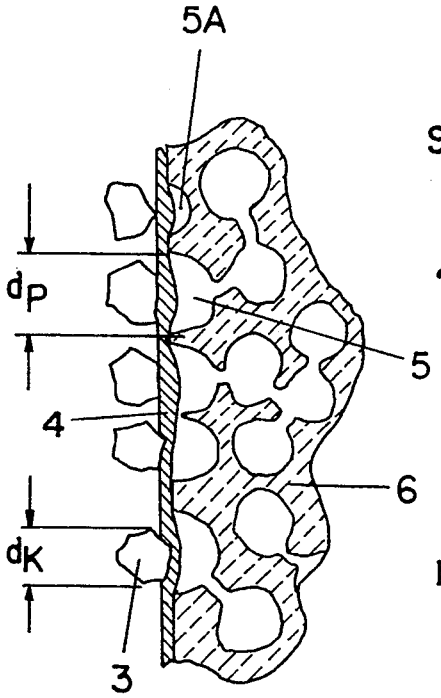
FIG. 2a
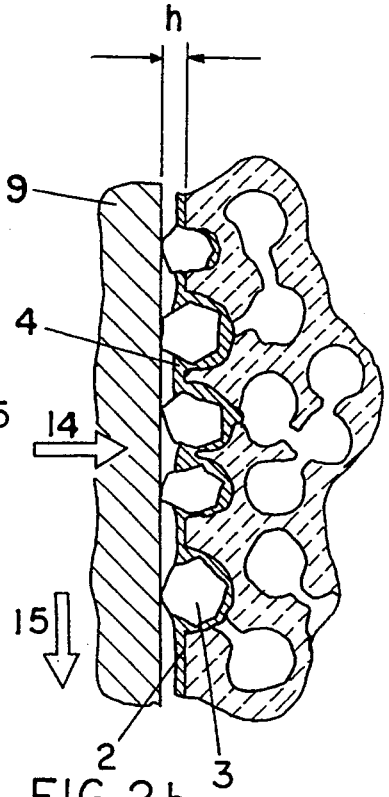
FIG. 2b
FIG. 4
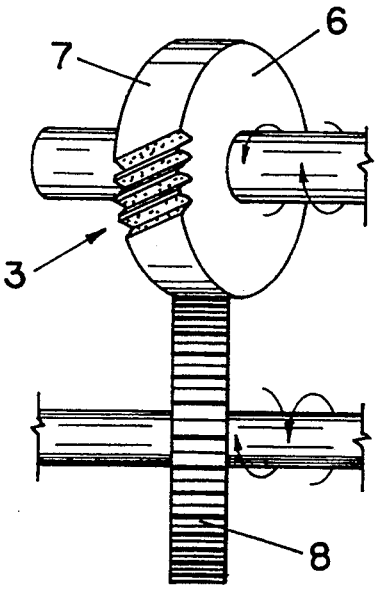
FIG. 3
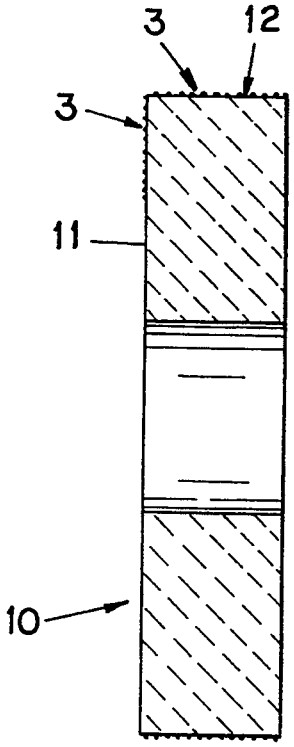

GRINDING TOOL AND THE LIKE MADE OF A CERAMIC MATERIAL COATED WITH EXTREMELY HARD ABRASIVE GRANULES

This is a continuation-in-part of U.S. Ser. No. 07/559,638, filed Jul. 30, 1990 now abandoned.

FIELD OF THE INVENTION

The invention relates to a grinding tool and the like made of a ceramic material coated with extremely hard abrasive grains or granules. It is specifically pointed out here that the terminology chosen, that is "grinding" and "grinding tool" is to be understood in the broadest sense, namely, that it includes in particular also "honing", "hard-gear finishing", "finish-grinding", "smoothing" and "dressing" and the tools used therefor. This is also true for the term "extremely hard abrasive grains or granules", which includes diamonds, CBN, Wolframcarbide granules and similar granules, as they are known in abrasive tools of the mentioned type, which are tools which do not have uniformly directed cutting edges.

BACKGROUND OF THE INVENTION

DE-OS 33 36 593 (corresponds to GB-2 150 058) discloses a tool coated with CBN grains or granules for the precision working of tooth flanks on workpiece gears, in which the tooth flanks are ground or lapped. The grinding or lapping of coated tooth flanks is extremely time-consuming and the tools coated with diamond granules and used for this purpose are very expensive to purchase.

U.S. Pat. No. 2,377,995 discloses a known grinding disk made of a ceramic material, the pores of which are filled with additives to improve the grinding characteristics. However, these additives are recognizably relatively soft materials, which are introduced dissolved or floated into the pores and are hardened therein. They have only the purpose to increase the strength of the brittle ceramic disk, which because of this brittleness has the tendency to break off without participating itself actively, namely chip-removingly, in the later grinding operation.

The basic purpose of the invention is to find means and ways with which tools of the mentioned type can be ground less expensively than heretofore. The grinding tool used for this purpose is suppose to be particularly simple and inexpensive to manufacture. Furthermore, the attainment is also suppose to be usable in other grinding tools and similar tools which are utilized in the precision working of gears.

SUMMARY OF THE INVENTION

The purpose is attained primarily by using a ceramic grinding tool as the base member and coating it with extremely hard abrasive granules to make a grinding tool.

BRIEF DESCRIPTION OF THE DRAWINGS

The invention will be described hereinafter in connection with three exemplary embodiments illustrated in five figures, namely:

FIG. 1 is a cross-sectional view of a plate-shaped grinding disk;

FIGS. 2*a* and 2*b* show an enlarged section, identified at II in FIG. 1, of a tool manufactured according to the invention, namely during its manufacture (FIG. 2*a*) and in the finished state (FIG. 2*b*);

FIG. 3 illustrates a gear-shaped grinding tool or similar tool; and

FIG. 4 is a cross-sectional view of a cylindrical grinding disk.

DETAILED DESCRIPTION

A plate-shaped grinding disk 1 (FIG. 1) made of a porous ceramic material is covered at least on one face 2 with extremely hard abrasive grains or granules 3. As shown in FIG. 2*b*, the abrasive granules 3 are only slightly smaller than the size of the pores in the face 2 of the disk 1. The face 2 to be covered is for this purpose thinly coated with an adhesive 4 and the abrasive granules 3 are applied immediately thereafter, for instance by sprinkling them on (FIG. 2*a*). The abrasive granules 3 are pressed against the grinding disk prior to the adhesive 4 starting to harden. The abrasive granules 3 move thereby into the pores 5 of the ceramic material 6 (FIG. 2*b*), into which pores the adhesive 4 had already "penetrated". Only one granule 3 enters a respective pore as shown in FIG. 2*b*. Further, and as shown in FIG. 2*b*, a limited segment of the granules project a distance h above the surface 6A of the ceramic material 6 to thereby enable a participation thereof in a working of a workpiece. The abrasive granules 3 can be pressed in with a suitably shaped pressing tool 9, only schematically indicated in FIG. 2*b*, which pressing tool is guided in direction of the arrow 14 toward the surface 2 of the base member up to the distance h from the surface 2. The grinding granules 3 project then with this measurement h above or outwardly from the surface 2, with which it is achieved that only they and not the ceramic base member carry out the later precision working. If one moves or turns the pressing tool also yet in addition transversely thereto (arrow 15), then such grinding granules 3, which do not "find" a pore 5, can be removed from the surface 2 by pushing or rolling. In the case of pores 5A, which are not sufficiently deep in order to receive a grinding granule 3, the ceramic structure breaks open locally under the grinding granule 3 due to the load of the pressing disk. The adhesive 4 is thereafter permitted to harden following the manufacturer's instructions. In the case of an adhesive on an epoxy-resin base, this can for example be done at approximately 150° C. for 2 hours. The adhesive 4, which exists on the surface 2 in a film-like layer and which is slightly thicker around the grinding granules 3 does not influence the function of the grinding disk 1, because it is worn off during a contact with a workpiece to be ground.

Of decisive significance is the selection of a suitable ceramic member as the carrier for the extremely hard grinding granules 3. The latter will be determined depending on the work to be carried out with the tool. For the grinding of hardened workpieces is used, aside from others, the granulation B 107 according to the international Norm ISO 6106 (B 107 means Bornitride granules with a grain diameter $d_K$ of 90 to 106 $\mu$m diameter corresponding with the mesh width of the testing sieve; the term common for this in the USA (also according to ISO 6106) is 140/170 corresponding with the number of sieve openings per square inch). No obligatory norms exist for the pore diameter $d_p$ of the ceramic grinding disks used as the base member. One must therefore find through tests a disk suitable for the granulation of the grinding granules 3 or, however, carry out suitable measurements or have suitable measurements carried out. As the base member to receive the mentioned B 107-granules, aside from others, a ceramically bound corundum grinding disk with the trade name 80 G/6 has proven to be suitable, in which the medium pore diameter $d_p$ was determined to be 136 μm. With this it is assured that almost each pore receives only one of the B 107 granules and those pores, which receive two granules, are an exception.

A grinding disk 1 equipped with diamond granules can be used both for grinding of gear-like tools coated with CBN granules according to DE-OS 33 36 593 and also for grinding of particularly hardened workpiece gears. A grinding disk coated correspondingly with CBN granules as above described is as a rule utilized for grinding of hardened workpiece gears. The grinding disk 1 operates in both cases only in the area of the outer peripheral edge of its plane surface 2.

The grinding disk according to FIG. 1 is briefly dressed, for example with a single granule diamond dresser, in the area of its outer contour in order to be able to work with the grinding disk. New abrasive granules are thereby exposed on the covered face 2 during each dressing, which abrasive granules function then as "cutting edges".

A gear-shaped tool 7 (FIG. 3) can principally in the same manner be covered with extremely hard abrasive granules on its tooth flanks. It must for this purpose be first exactly aligned and exactly ground. The tool 7 is permitted to roll along with a master gear 8 in order to press in the abrasive granules 3. The center distance between the master gear 8 and the ceramic base member is thereby adjusted as if between the tooth flanks of the master gear 8 and the ones of the ceramic base member there exists a flank clearance, which corresponds with twice the measurement h, at which the extremely hard grinding granules 3 are supposed to project from the tooth flanks of the base member. FIGS. *2a*, *2b* are here also accordingly valid, with the schematically indicated pressing tool 9 to be envisioned as a part of a longitudinal cut through a tooth of the master gear 8.

Finally, it is also possible for a grinding disk 10 having an active surface on its peripheral surface 12 and having a circular cross section (cylindrical, conical, spherical, etc.), a possible form being shown in FIG. 4, to be covered principally in the same manner with extremely hard abrasive granules. The grinding disk is, as before, exactly aligned and dressed for this purpose. To press in the abrasive granules 3, the grinding disk 10 is permitted to roll along on a suitably formed countersurface or such a countersurface is guided along the rolling grinding disk. If the grinding disk 10 is also covered on one or both faces 11, one can proceed in the same manner as above-described in connection with the plate-shaped grinding disk 1.

The embodiments of the invention in which an exclusive property or privilege is claimed are defined as follows:

1. In a tool suited for a precision working of hardened workpieces comprising a base member covered with extremely hard grinding granules, the improvement wherein the base member consists of a porous ceramic material having a plurality of outwardly open pores of a predetermined average pore diameter ($d_p$) provided in an area of a work surface, wherein extremely hard grinding granules having an average granule diameter ($d_K$) are provided and are received in the outwardly open pores, wherein an adhesive is provided for adhesively securing the extremely hard grinding granules in the outwardly open pores, the average granule diameter ($d_K$) of the extremely hard grinding granules being only a little less than the average pore diameter ($d_p$) so that the plurality of outwardly open pores, aside from the adhesive, each receives only one extremely hard grinding granule therein, and wherein the extremely hard grinding granules received in the outwardly open pores project a specific measurement (h) from the work surface of the base member, which assures that only the extremely hard grinding granules participate in the precision working.

2. The tool suited for a precision working of hardened workpieces according to claim 1, wherein the tool is a gear-shaped tool having a plurality of tooth flanks thereon for precision working of tooth flanks of gears, and wherein the extremely hard grinding granules are adhesively secured by the adhesive into the outwardly open pores in an area of the tooth flanks of the gear-shaped tool.

* * * * *